US007320233B2

(12) United States Patent
Lonati

(10) Patent No.: US 7,320,233 B2
(45) Date of Patent: Jan. 22, 2008

(54) CONTROL DEVICE FOR LINEAR KNITTING MACHINES THREAD-GUIDE BARS

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 11/714,017

(22) Filed: Mar. 5, 2007

(65) Prior Publication Data

US 2007/0209402 A1 Sep. 13, 2007

(30) Foreign Application Priority Data

Mar. 8, 2006 (IT) ..... BS2006A0056

(51) Int. Cl.
*D04B 23/22* (2006.01)

(52) U.S. Cl. ..... 66/207

(58) Field of Classification Search ..... 66/203, 66/204, 205, 206, 207, 208
See application file for complete search history.

(56) References Cited

U.S. PATENT DOCUMENTS

| | | | | |
|---|---|---|---|---|
| 2,786,344 | A * | 3/1957 | Fritz et al. | 66/207 |
| 3,403,536 | A * | 10/1968 | Kunzi Inabi | 66/207 |
| 3,802,226 | A * | 4/1974 | Kohl | 66/204 |
| 4,835,989 | A * | 6/1989 | Hall et al. | 66/203 |
| 6,289,703 | B1 * | 9/2001 | Kress et al. | 66/207 |
| 6,959,566 | B2 | 11/2005 | Zorini et al. | |
| 2004/0261464 | A1 | 12/2004 | Mista | |

FOREIGN PATENT DOCUMENTS

DE 100 26 983 A1 12/2001

OTHER PUBLICATIONS

Spencer, David J., "Knitting Technology", Pergamon Press Second Edition, 1989, pp. 1-2, 266.
Wilkens, Chris, "Warp Knit Machine Elements", U. Wilkens Verlag, Heusenstamm, Germany, 1997, pp. 1-2, 16, 55, 57.

* cited by examiner

*Primary Examiner*—Danny Worrell
(74) *Attorney, Agent, or Firm*—Pearne & Gordon LLP

(57) ABSTRACT

A control device (1) for thread-guide bars (2) of linear knitting machines, comprising a linear motor (10) designed to impart a translational motion to the thread-guide bar (2), means (40) for moving the thread-guide bar (2) according to an oscillating motion basically perpendicular to the translational motion, and transmission means (20) for transmitting to the thread-guide bar (2) the translational motion of the linear motor (10), thus enabling the oscillating motion. The device (1) is characterized in that the transmission means (20) include a first transmission element (21) associated to and integral with the linear motor (10), and a second transmission element (24) that can be integrally connectable to the thread-guide bar (2). Moreover, the first transmission element (21) has a first guide (22) having preferably a basically curved shape, in which the second transmission element (24) is movably engaged.

25 Claims, 10 Drawing Sheets

PRIOR ART

PRIOR ART

PRIOR ART

CONTROL DEVICE FOR LINEAR KNITTING MACHINES THREAD-GUIDE BARS

The present invention relates to a control device for thread-guide bars of linear knitting machines such as Raschel-type warp looms and the like.

As is known, linear knitting machines are provided with a plurality of bars designed to carry a plurality of thread-holding elements commonly known as thread-guides. Said bars should be handled so as to enable the threads associated to said thread-guides to be correctly fed onto the needles of the knitting machine for the form ation of new fabric with the well-known technique in which the new thread enters the old loop and the old loop is discharged and becomes part of the fabric being formed.

In order to achieve its knitting task, the thread-guide bar makes two basic movements simultaneously, i.e. a first linear movement in front of the hook of each needle, commonly known as "shog", and an oscillating movement on the side of each needle for bringing the threads alternatively before and behind the needle hook, commonly known as "swing".

A first example of known control devices for thread-guide bars on linear knitting machines are of mechanical type. These systems are disclosed for instance in handbooks that are generally known in the textile field, such as "Knitting Technology" by D. J. Spencer (Pergamon Press 1989 $2^{nd}$ edition) FIG. 2 page 266, shown in the accompanying drawings as FIG. 1A, and "Warp Knit Machine Elements" by C. Wilkens (U. Wilkens Verlag, Heusenstamm Germany 1997) FIG. 2.2.1 page 16 and FIG. 7.1.2 page 55. Such systems generally include a drum with fixed cams (or in the form of a chain), which turns around its axis and causes the shift of a lever pivoting on another axis and connected in its turn to a jointed system connected to the thread-guide bar. As a result of the thrust of the cam, said lever pushes forward a jointed rod which in its turn pushes forward the thread-guide bar and enables the shift thereof required for the "shog" movement. The "swing" movement of the thread-guide bar is caused by a suitable lever which makes the thread-guide support oscillate in accordance with the "shog" movement.

The return of the thread-guide bar is achieved by means of strong springs connected to the bar, which take the bar back to its initial position so as to receive another forward thrust by the following cam located on the turning drum.

The rod pushing the bar forward should necessarily be jointed so as to enable also the oscillating movement imparted to the thread-guide bar by the support to which it is anchored.

The drawback of such devices consist in that they have a very large number of mechanical components, which make the structure of the knitting machine highly complex since the thread-guide bar should work with an extremely high accuracy also because these components are subject to external factors such as temperature.

In a variant of the devices referred to above, the drum is made up of a system including a control motor, usually a brushless or stepping motor, so as to partially solve the drawbacks pointed out, as shown in document U.S. Pat. No. 6,959,566, in particular in FIG. 1.

Depending on the circumstances, said motor can move a crank connected to its axis of rotation and to a jointed rod (connecting rod), which is in turn connected to the thread-guide bar.

Thus, the motor with its oscillating motion makes a movement both of forward thrust and of backward thrust of the jointed rod, and therefore there is no need to use return springs.

Brushless motors were developed for making complete rotations and, moreover, the maximum transmitted torque occurs from a given number of revolutions, typically from 2.000-3.000 revolutions. In the applications on linear knitting machines for controlling the thread-guide bars, conversely, limited portions of round angle are used, generally of about ±5°-10°. Each motor is piloted in a sophisticated manner so as to make the angular shifts of its axis correspond to linear shifts of the thread-guide bar.

As a result of the factors herein pointed out, it is evident that such devices do not have high accuracy levels as far as movement is concerned, since the systems intrinsically tends to amplify the angular error of the drive shaft, and they cannot work at the high speeds required by some types of linear knitting machines.

Moreover, the use of brushless motors for limited angular movements makes the performance of said motors extremely low and gives rise to definitely high consumption levels.

Also the use of stepping motors instead of brushless motors gives rise to some problems that should not be neglected. As a matter of fact, said motors can make in one revolution a given number of angular positions, typically 200. Accordingly, the positions in which the motor can be stopped are finite and depend on the number of steps characterizing the motor.

Another known system for the movement of thread-guide bars includes the use of a brushless motor (or, if necessary, of another suitable type of motor) with a pulley fitted thereon, around which is wound a steel band (for instance a sheet or a toothed belt), which can be connected to the thread-guide bar so as to pull the bar. The return movement of the thread-guide bar can be created by a return spring or by another similar system associated to the opposite end portion of the bar. Such solution is shown in FIGS. 1B, 1C and 1D.

The use of a double motor is penalizing both from the point of view of costs and of the overall size of the machine.

In a further variant of the control devices for thread-guide bars disclosed, linear actuators are used for converting the rotational movement of the motor into a linear movement.

Such devices are characterized by a brushless or stepping motor onto whose transmission shaft is fitted an actuator in the form of a screw along which is placed a female thread connected directly and fastened to the element to be moved. These devices are shown in detail in FIG. 7.1.4 of the handbook "Warp Knit Machine Elements" referred to above and in FIGS. 1, 3 and 4 of document US 2004/0261464. The rotational movement of the transmission shaft turns the screw, which goes neither forward nor backward but pushes the female thread, and therefore the thread-guide bar, forward or backward. The fitting system between the transmission shaft and the screw can simply include a joint or a sophisticated reduction system, which after many revolutions of the motor makes the screw partly rotate on its axis.

The system is generally provided with a sensor reading the position of the bar and transmitting it to the electronic system controlling movement.

These systems are characterized by problems of premature wear due to the high shifting speeds and to the difficult lubrication of the movable elements.

A further example of known control devices for thread-guide bars on linear knitting machines uses linear motors characterized in that they can be fitted directly onto the body to be moved without the need for intermediate elements for transmitting motion, and in that they can make rapid and accurate shifts with extremely low clearances, as shown in FIG. 2.

These motors are characterized by the use of magnets obtained by synthesis of the so-called rare earths, mixed and combined together and then permanently magnetized with suitable techniques.

In this case the thread-guide bar is moved forward and backward for making the "shog" movement but cannot oscillate, and therefore the combined movement of lifting, oscillation between the thread-guides and descent on the needle-bed is carried out by the needles. As a consequence, the typical oscillation of the thread-guide bar for making the "swing" movement was replaced by the oscillation of the needles.

Such systems can also exploit the oleodynamic technology so as to amplify the forces imparted by the motor, however to the detriment of the movement execution speed. Thus, thread-guide bars with a length above three meters, which would require the use of large-sized and therefore expensive linear motors, are moved by far smaller linear motors together with suitable hydraulic systems.

In these devices the linear motor makes a movement both of forward thrust and backward thrust of the thread-guide bar without the help of return springs.

These devices, however, have the drawback consisting in that they require complex electronic and mechanical systems in the machine, since the two basic movements are carried out by two different components and since the needle-guide bars are very strong and heavy.

The state of the art also shows systems using linear motors which make both the "shog" and the "swing" movement. Such devices require a jointed connecting rod between the motor and the thread-guide bar so as to transmit the linear movement of forward and backward translation and to enable the oscillating movement generally imparted by the support to which the bars are anchored. This type of known machines is shown in the accompanying FIGS. 3A and 3B and in document DE 10026983.

Linear knitting machines have generally four to eight thread-guide bars, spaced one from the other and moving all together in oscillation and separately for forward and backward movements. As a consequence, the size of the machine is quite large since every thread-guide bar is associated to a linear motor, to a hydraulic amplification device, to a jointed connecting rod and to a dampening system.

Moreover, the front size ratio between the thread-guide bar and the motor is highly unbalanced since motors placed side by side generally occupy a surface that is approximately 10-15 times bigger than the surface of bars, and therefore no jointed rod works lined up with the thread-guide bar and the linear motor. When the thread-guide bars oscillate, the rods pivoting on the fixed motors describe each a different arc of circumference due to their misalignment with the motor. Therefore, every device should be adjusted so as to work accurately in the narrow spaces defined by needle shed (i.e. by the distance between the needles) so as to avoid the risk that needles located above intercept threads that should instead go through untouched, and form fabric when they should not and conversely. This also explains the reason why a motor should be associated to a single bar since its shift depends on the position of the bar in the group of bars.

The need for a complex calibration always requires qualified personnel for any operation involving replacement or maintenance carried out on the machine.

Also these devices are extremely complex, since the transmission of the two basic movements makes use of various components such as hydraulic amplification systems, the rod and the joints to which said rod is connected. As a consequence, it is difficult to move the thread-guide bars accurately since they are quite long (even above three meters) and should undergo very accurate shifts in the presence of external disturbances such as temperature changes.

Moreover, because of the large number of internal components, such knitting machines are quite bulky and, thus, expensive and difficult to be carried and placed inside the manufacturing layout of a plant.

An aim of the present invention consists in solving the problems existing at the state of the art by proposing a control device for thread-guide bars of linear knitting machines that is not affected by the drawbacks described above.

Therefore, an aim of the present invention consists in proposing a control device for thread-guide bars of linear knitting machines that is compact and has a limited number of components so as to result in advantages as far as costs and service life are concerned, and to simplify the management of said machine. A further aim of the present invention consists in disclosing a control device for thread-guide bars of linear knitting machines that is extremely accurate and in which the clearances between the various components are minimized. Still another aim of the present invention consists in showing a control device for thread-guide bars of linear knitting machines that allows the bar to make both basic movements required for correctly feeding the thread onto the needles for the formation of new fabric. A further aim of the invention consists in providing a control device for thread-guide bars of linear knitting machines that enables high use speeds (high dynamics), that is simple to carry out and with low costs. Eventually, an aim of the present invention consists in proposing a control device for thread-guide bars of linear knitting machines that enables to obtain high-quality finished items and to minimize the likelihood of positioning the thread outside the operating area.

These and other aims that will be more apparent from the following description are achieved in accordance with the present invention by means of a control device for thread-guide bars of linear knitting machines according to the appended claims.

Further characteristics and advantages of the invention will be more apparent from the description of a preferred but not exclusive embodiment of the device, as shown to a merely indicative purpose in the following drawings.

Figure 1A:
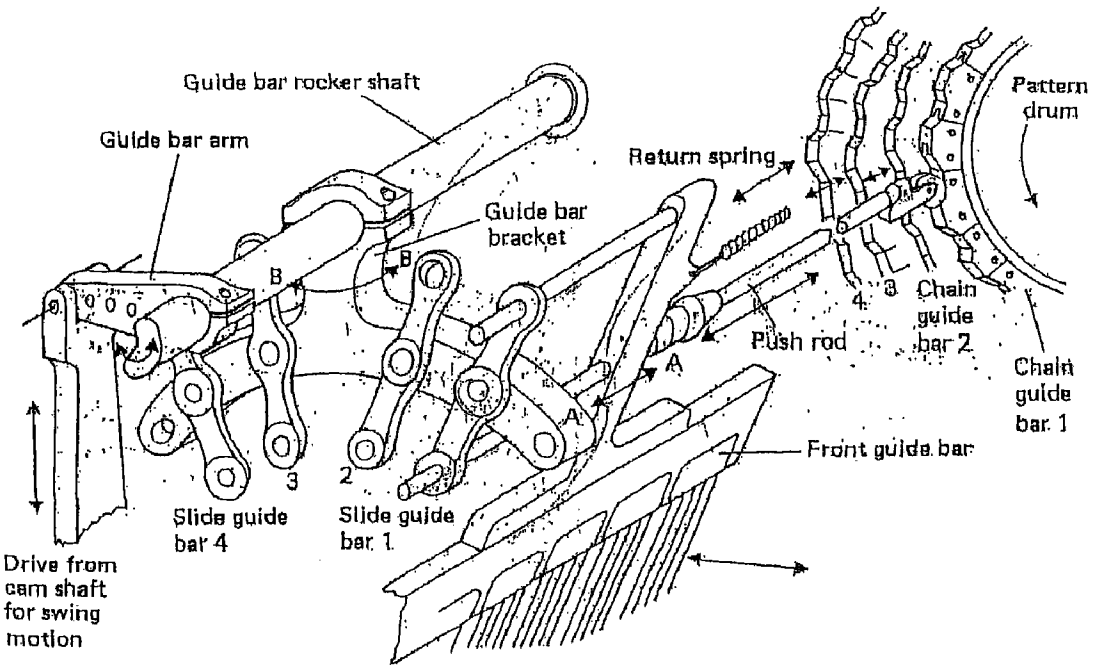
FIGS. 1A, 1B, 1C, 1D, 2, 3A and 3B show examples of known control devices for thread-guide bars of linear knitting machines.
Figure 1B:
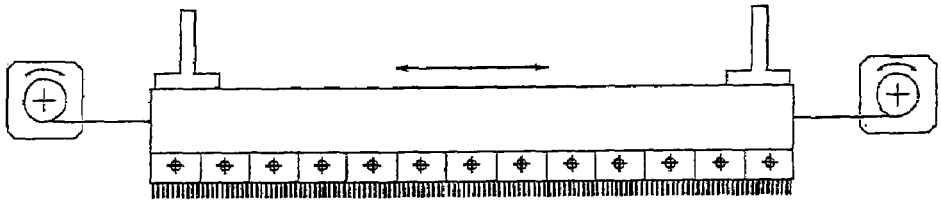
Figure 1C:
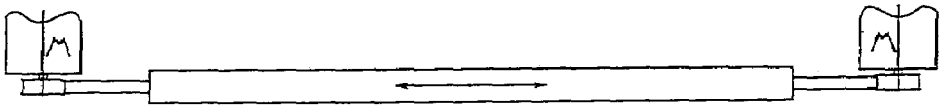
PRIOR ART Fig. 1C
Figure 1D:
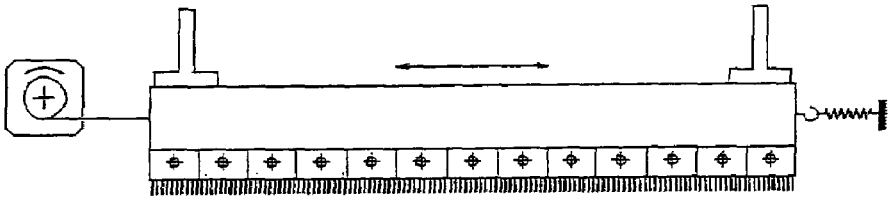
PRIOR ART Fig. 1D
Figure 2:
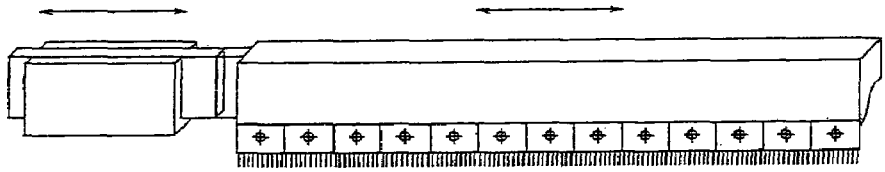

With reference to the figures mentioned above, a control device 1 for thread-guide bars 2 of linear knitting machines according to the invention comprises a linear motor 10 designed to impart a translational motion to the thread-guide bar 2, means 40 for moving the thread-guide bar 2 according to an oscillating motion basically perpendicular to said translational motion, and transmission means 20 for transmitting to the thread-guide bar 2 the translational motion imparted by the linear motor 10, enabling said bar 2 to move with an oscillating motion.

The device 1 according to the present invention is characterized in that the transmission means 20 comprise a first transmission element 21 associated to and integral with the linear motor 10, and a second transmission element 24 that can be associated integrally to the thread-guide bar 2. The first transmission element 21 further has a first guide 22 in which the second transmission element 24 is movably engaged.

Advantageously, the first guide 22 has a basically curved shape so as to enable the oscillating motion of the thread-guide bar 2. In particular, the first transmission element 21 is provided with an inner recess 23 having at least a basically curved shape so as to represent said guide 22 for the second transmission element 24, as can be inferred from FIGS. 5, 7A, 7B and 8. Said element 24 is provided in its turn with a first end portion 25 matching said recess 23 so as to oscillate therein and enable the oscillating motion.

Preferably, said recess 23 is defined by two discrete portions 21*a* of the first transmission element 21. In a preferential execution variant of the device 1, said recess 23 has a quadrilateral side section and a curved front section, whereas the second transmission element 24 has a quadrilateral side section and a circular front section so as to slide within the recess 23.

Figure 5:
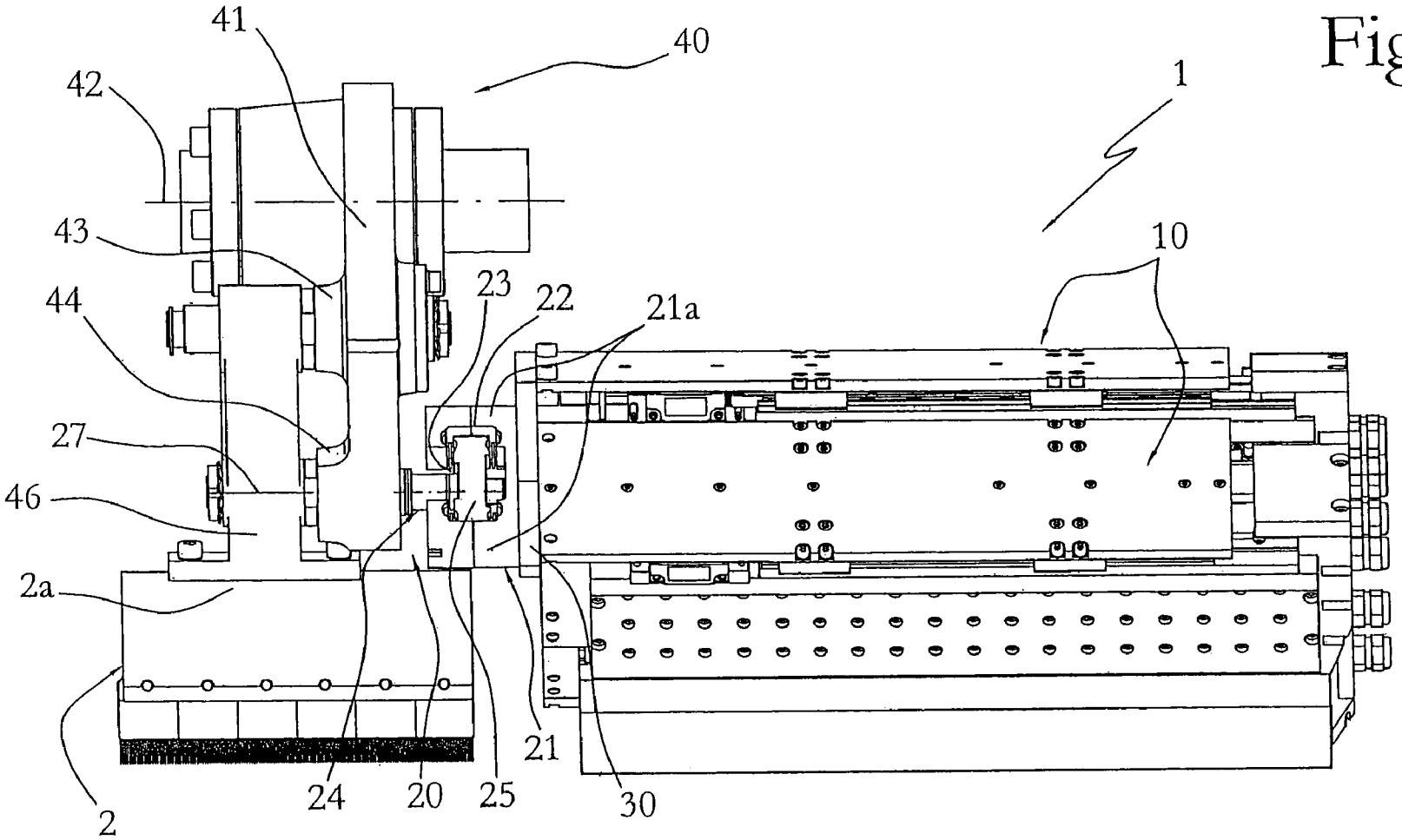
FIG. 5 shows a side view of the device of FIG. 4.

The transmission means 20 also comprise a plurality of spheres 28 placed between the first 21 and the second transmission element 24 in the recess 23 (FIG. 5). Moreover, these means 20 comprise a plurality of fastening elements 29 designed to increase the pressure between the first transmission element 21, the second transmission element 24 and the spheres 28 in the recess 23 (preloading) so as to minimize clearances between the first 21 and the second transmission element 24. In particular, the fastening elements 29 include screws associated to the first transmission element 21 so as to have the middle axis basically parallel to the one of the first element 21 and thus ensure the fastening of said element 21 to the motor 10. As a result of the action of the screws, the space between the first 21 and the second element 24 in the recess 23 is minimized, but the radial sliding between the two elements 21, 24 is ensured by the action of the spheres 28.

Figure 11:
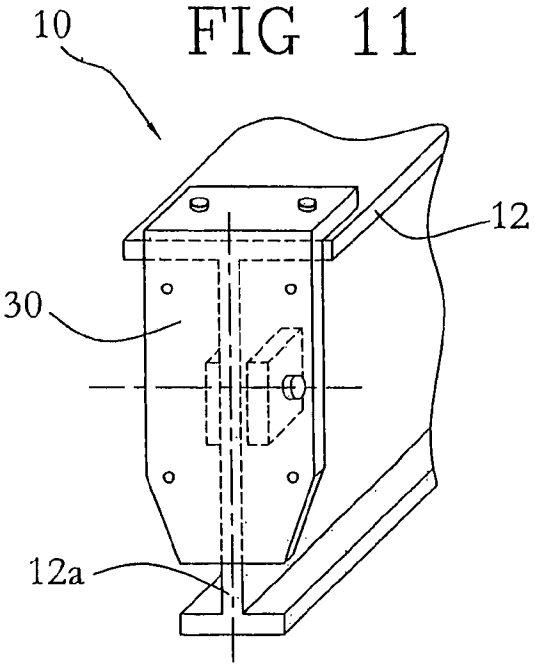
FIG. 11 shows an axonometric front view of an interface plate associated to the linear motor of FIG. 10.

According to the invention, the transmission means 20 further include an interface plate 30 fastened to the linear motor 10 and shown in detail in FIG. 11. The first transmission element 21 is thus associated to the motor 10 by means of said interface plate 30 and also the fastening elements 29 are associated to the interface plate 30.

The second transmission element 24 is integrally associated to the thread-guide bar 2 by means of a second end portion 26 thereof (FIG. 5, 7A e 7B). Said element 24 further has a middle axis 27 that is always parallel to a direction of the translational motion, i.e. also to the middle axis of the first transmission element 21 and to the one of the motor 10.

As is known, the linear motor 10 includes at least one fixed part 11 and a movable part 12.

According to the invention, the fixed part 11 comprises coils designed to generate an electromagnetic field when an electric current gets through them, and the movable part 12 comprises magnets that are sensitive to said electromagnetic field. As a consequence, the movable part 12 is moved so as to generate the translational motion to be imparted to the thread-guide bar 2 as a result of said electromagnetic field acting upon said magnets.

Therefore, it is the movable part 12 of the motor 10 that transmits to the thread-guide bar 2 the translational motion through the transmission means 20. As a matter of fact, the interface plate 30 or the first transmission element 21, if no interface plate 30 is present, are fastened to an end portion 12*a* of the movable part 12 of the motor 10. The end portion 12*a* of the movable part 12 of the motor 10 can therefore have any shape provided that the latter enables the fastening to an interface plate 30 or, if desired, to the first transmission element 21.

In the linear motor 10 of the device 1 according to the present invention, the coils can be associated to the movable part 12 and the magnets to the fixed part 11. However, in this case the reciprocal movement of the two parts would be more difficult since the electrical supply cables should be associated to the movable part 12 and would thus be subject to continuous shifts and vibrations.

In a preferred embodiment of the device 1, the motor 10 used is a iron-core horizontal linear motor piloted with direct current at 540 V or with alternate current at 110 V to 220 V, with fixed supply cables (since they are associated to the fixed part 11 of the motor 10).

Figure 6:
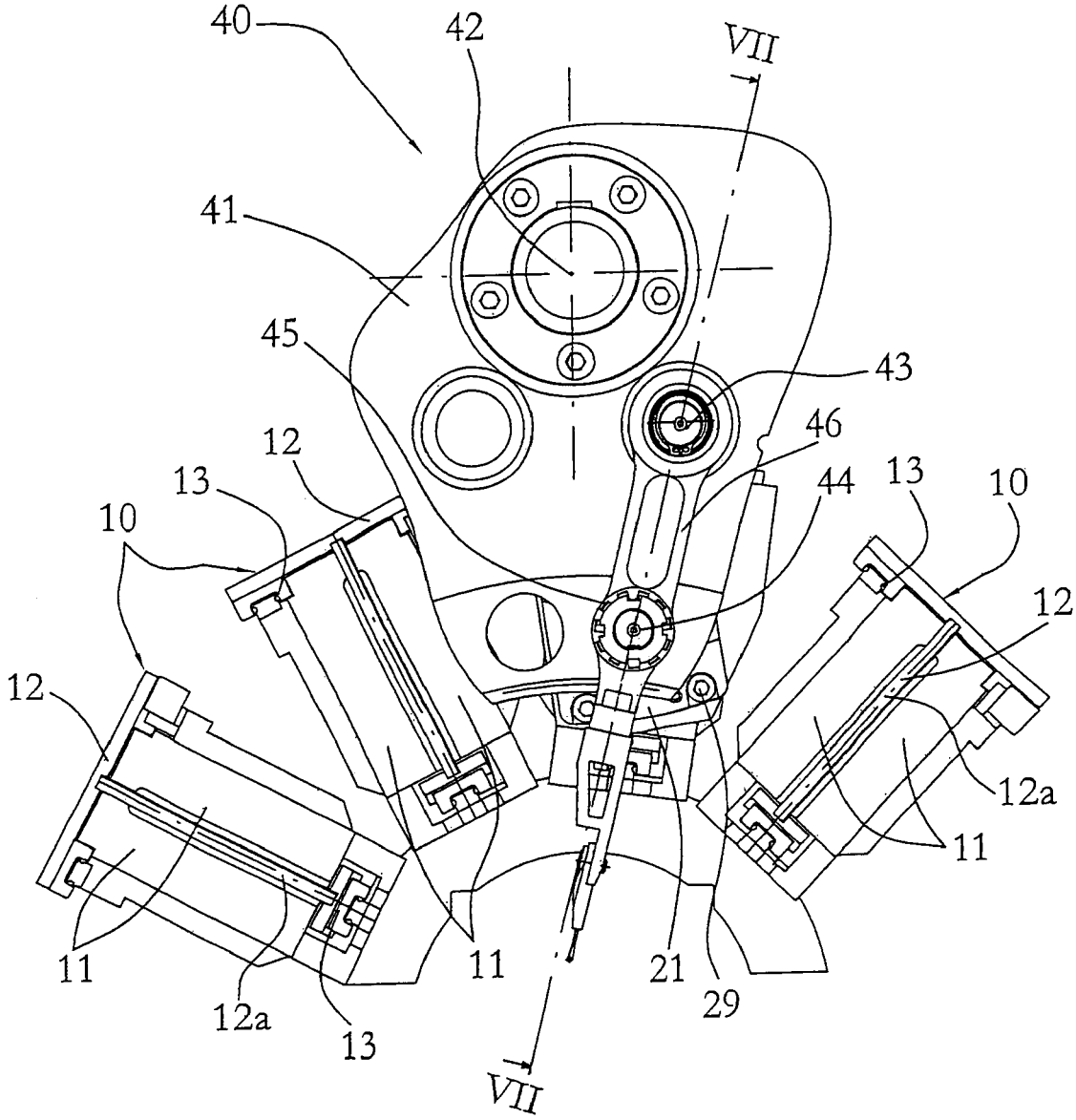
FIG. 6 shows a front view of the device of FIG. 4, in which the motors are in accordance with a first execution variant.
Figure 9B:
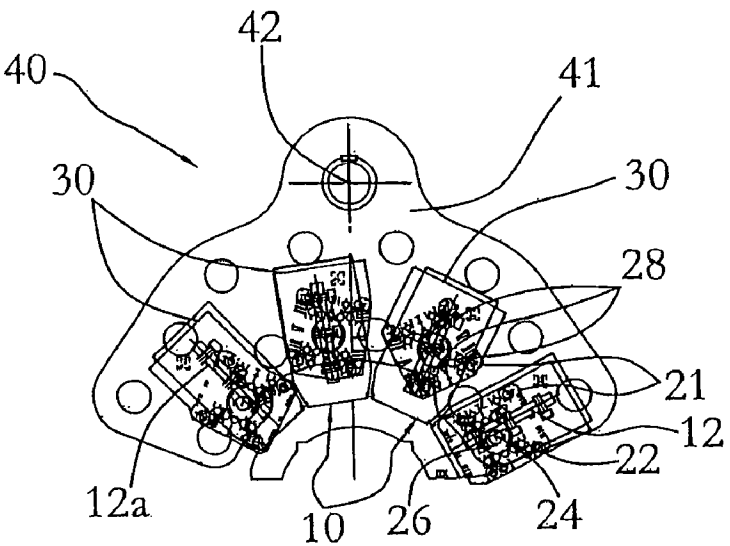
FIG. 9B shows a support of the linear knitting machine of FIG. 9A associated to a second end portion of the thread-guide bars.
Figure 9A:
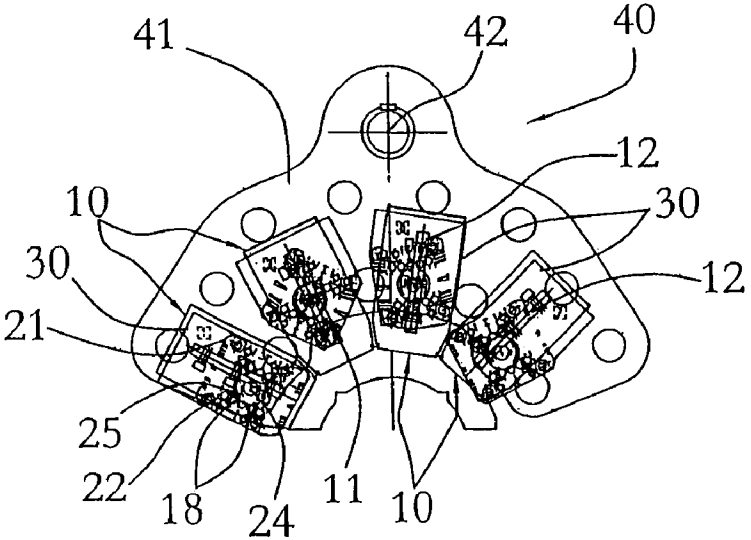
FIG. 9A shows a support of a linear knitting machine according to the invention associated to a first end portion of the thread-guide bars, in which the motors are in accordance with a second execution variant.
Figure 12:
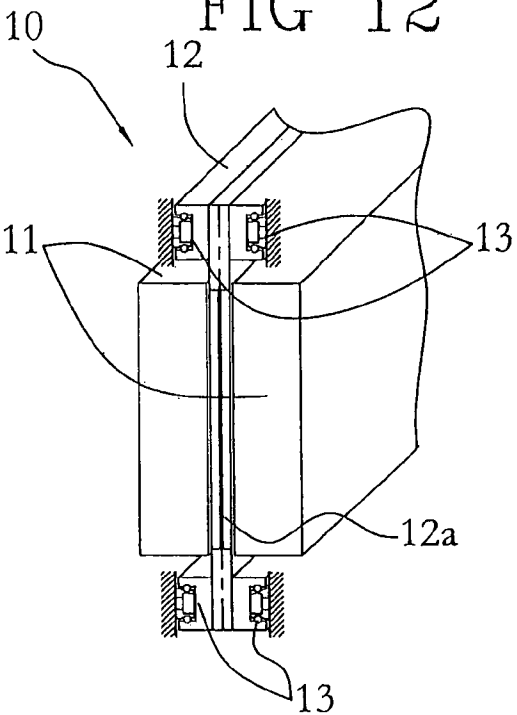
FIG. 12 shows an axonometric front view of a linear motor of the device of FIG. 4 in its second execution variant.
Figure 10:
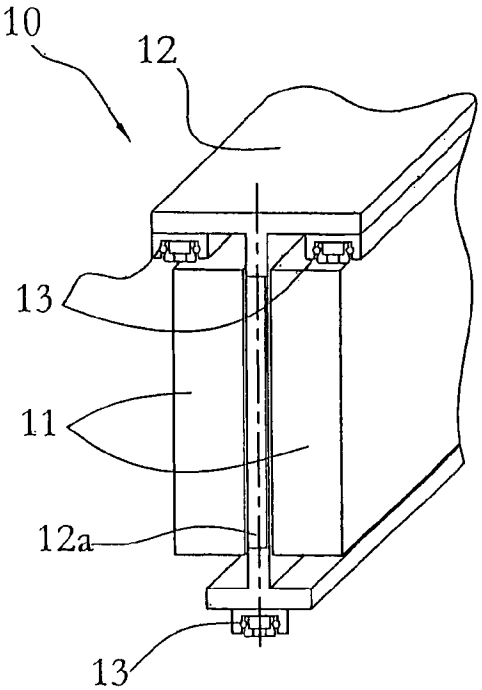
FIG. 10 shows an axonometric front view of a linear motor of the device of FIG. 4 in its first execution variant.

Advantageously, the motor 10 is characterized in that its movable part 12 is basically T-shaped and is placed between at least two fixed parts 11. It is thus possible to highly reduce the overall size of the motor 10, especially in the area getting in contact with the thread-guide bar 2, thus overcoming the severe limitation of known devices due to the significant size difference between the movable part 12 of the motor 10 and the thread-guide bar 2. Moreover, the motor 10 can be boosted by increasing its length and, therefore, the longitudinal extension, both of the fixed part 11 and of the movable part 12, so as to be able to use the device 1 also for applications requiring a high power. In a preferred embodiment of the device 1, the movable part 12 of the motor 10 is basically shaped as a double T, and generally the horizontal upper portion of the T has a larger front extension than the lower portion, still in order to minimize the front size of the motor 10 with respect to the thread-guide bar 2 (FIGS. 6, 10 and 11). In order to reduce the size difference between the motor 10 and the corresponding thread-guide bar 2, the I shape of the movable part 12, as shown in FIGS. 9A, 9B and 12, is as valid as the previous one. More to the point, it should be pointed out that the reduction of the front size difference between the motor 10 and the corresponding thread-guide bar 2 enables the motor 10 to operate in continuous alignment with the corresponding bar 2.

According to the invention, the motor 10, whatever the shape of its movable part 12, comprises at least one second sliding guide 13 for the movable part 12. Advantageously, the motor 10 is equipped with at least two of said sliding guides 13 placed between the fixed part 11 and the movable part 12. Said guides 13 also simplify the translational sliding of the movable part 12 with respect to the fixed one 11 and minimize the mutual distance (known as air gap) and therefore the overall size of the motor 10, preventing the movable part 12 from swinging laterally with motor 10 on or off and, in extreme cases, letting coils and magnets crash with one another. Generally, the motor 10 is associated to very accurate sliding guides 13 with spheres or rollers that are crossed with migration and preloaded, opposed or the like. Moreover, as can be inferred from FIGS. 10 and 12, there are basically three second sliding guides 13 in case of motors 10 whose movable part 12 is T-shaped, and four of them in case the movable part 12 is I-shaped.

Furthermore, the device 1 can include detection means (not shown) acting upon the motor 10 so as to drive and control the movement of the movable part 12 with respect to the fixed one 11. Advantageously, said detection means comprise at least an accurate linear position transducer that can be magnetic, optical, with variable reluctance etc.

The fixed part 11 of the motor 10 is generally anchored to a containing body (case) acting as supporting frame also for the other parts of the motor 10.

In a preferred embodiment of the device 1, the means 40 for moving the thread-guide bar 2 with the oscillating movement are associated to and cooperate with the transmission means 20. The means 40 for moving and the transmission means 20 are furthermore advantageously integrated with one another and placed between the motor 10 and the thread-guide bar 2.

According to the invention, the means 40 for moving include a support 41 designed to move with an oscillating motion around an axis of rotation 42, slidingly associated to the second transmission element 24 on at least one first engagement portion 43.

Said support 41 further has a second engagement portion 44 slidingly associated still to the second transmission element 24, so as to transmit stiffly the oscillating motion to the thread-guide bar 2.

Advantageously, the support 41 is engaged to the second transmission element 24 on the first 43 and on the second engagement portion 44 by means of sliding sleeves 45 enabling the second transmission element 24 to move with a translational motion even if the support 41 is fixed with respect to the translation and makes only an oscillating movement.

The second transmission element 24 can therefore be basically L- or T-shaped and be connected directly to the thread-guide bar 2 and to the support 41 on said two engagement portions 43, 44.

Figure 7B:
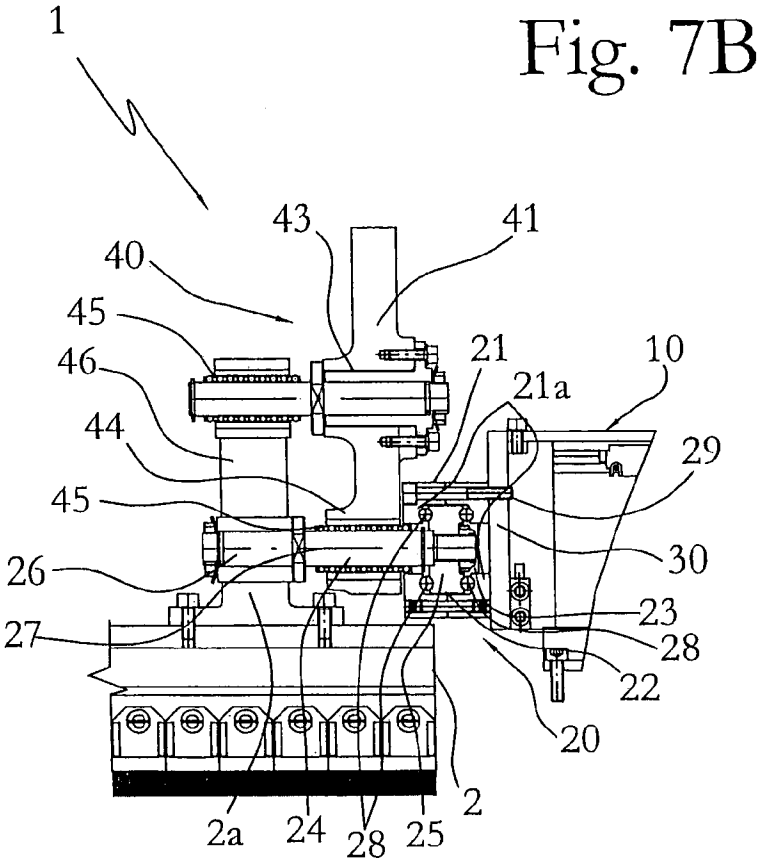
FIG. 7B shows the same device as in FIG. 7A associated to a second end portion of the thread-guide bar.
Figure 7A:
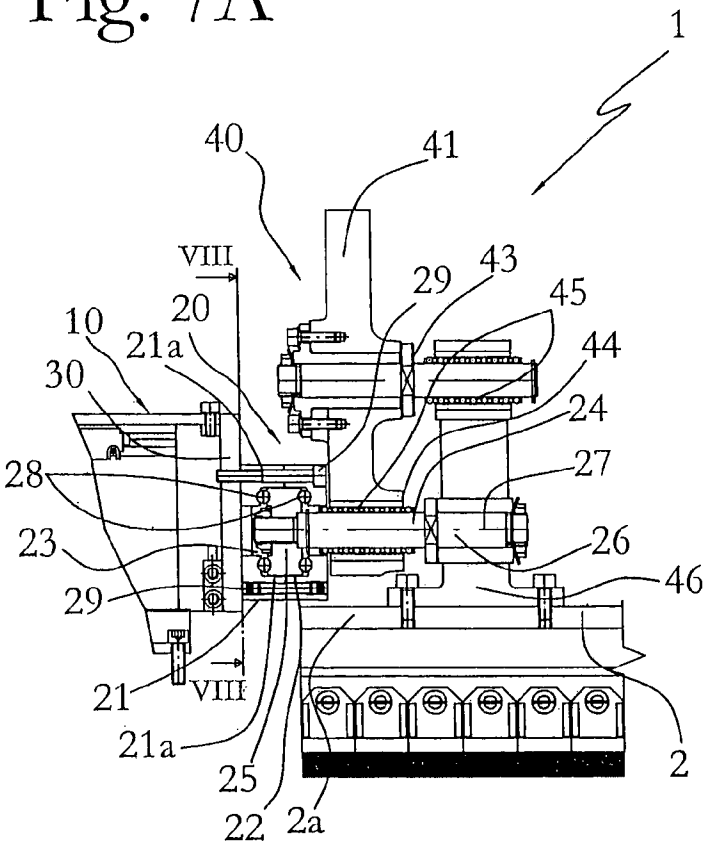
FIG. 7A shows a section of the device of FIG. 6 according to line VII-VII.
Figure 8:
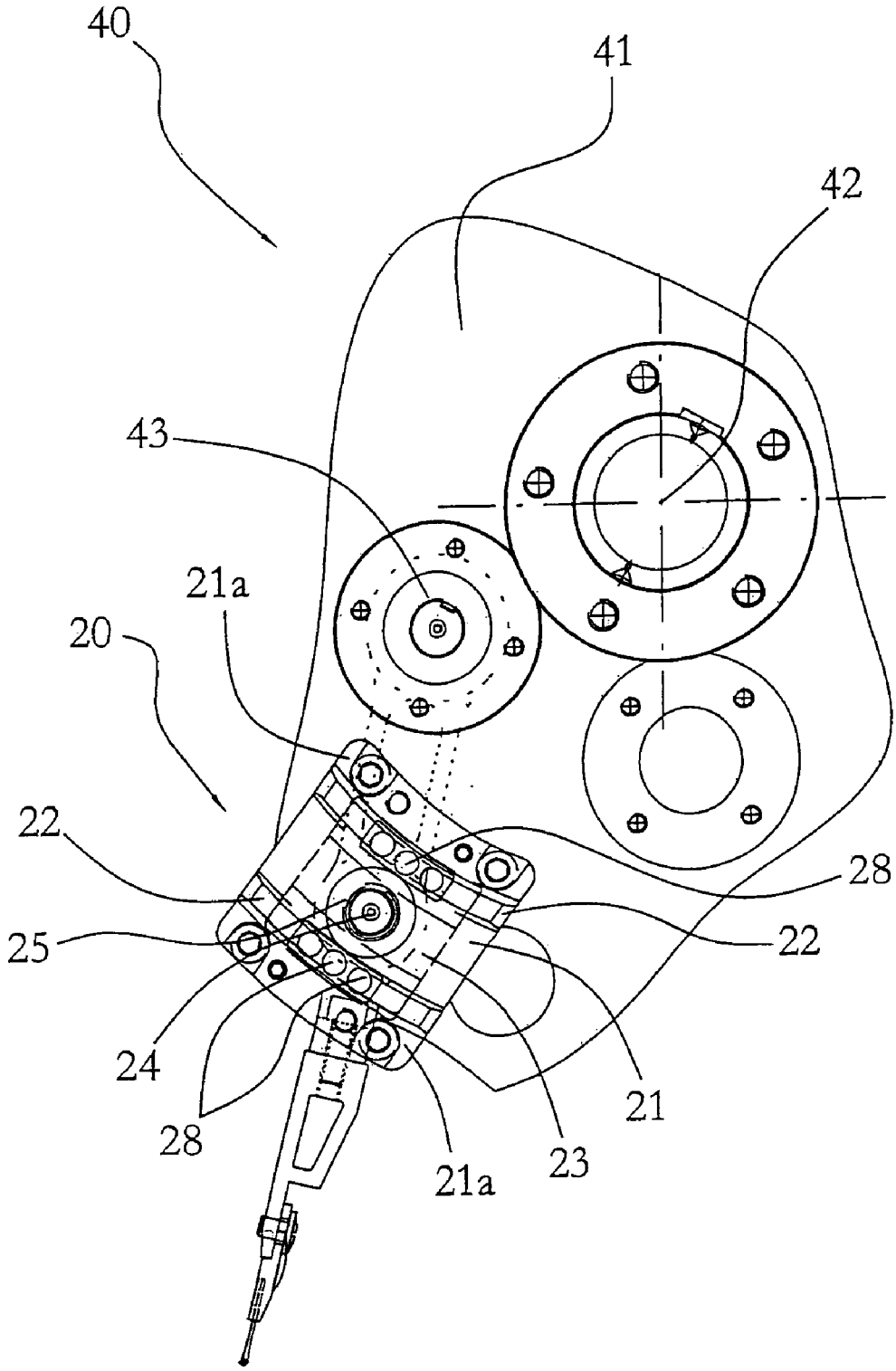
FIG. 8 shows a section of the device of FIG. 7A according to line VIII-VIII.

Alternatively, in a preferred embodiment of the device 1, the latter can comprise a supporting element 46 integrally connected to the thread-guide bar 2 and to the second transmission element 24, on its second end portion 26, preferably so that the middle axis of the second transmission element 24 is basically parallel to the one of the thread-guide bars 2 and that the middle axis of the supporting element 46 is basically perpendicular to both axes (FIGS. 4, 5, 6, 7A, 7B, 9A and 9B). As a result, the support 41 is connected to the supporting element 46 on the first engagement portion 43, by means of a sleeve 45, and to the second transmission element 24, still by means of a sleeve 45, on the second engagement portion 44. Preferably, the device 1 is provided with a first sleeve 45 associated to the supporting element 46 on the first engagement portion 43 of the support 41, and with a second sleeve 45 associated to said support 41 on the second engagement portion 44. Therefore, in this case the two sleeves 45 are opposed to one another, as can be seen in FIGS. 7A and 7B.

The engagement between the second transmission element 24, and possibly between the supporting element 46, and the support 41 is highly innovative. It should thus be pointed out that the present invention also protects a device 1 having a support 41 designed to move with an oscillating motion and associated to a transmission element 24 on two engagement portion 43, 44, preferably by means of sleeves 45, so as to transmit stiffly to the thread-guide bars 2 an oscillating motion and enable the translational motion, wherein the transmission element 24 is associated to a motor 10 by means of known systems such as jointed rods.

The operation of the device 1 according to the invention in an preferential execution variant can be summarized as follows.

The linear motor 10, through its movable part 12, imparts a translational motion to the first transmission element 21 by means of the interface plate 30. Such translational motion is then transmitted to the second transmission element 24, which is stiff and integral in terms of translation with respect to the first transmission element 21. In its turn, said second transmission element 24 transmits the translational motion to the thread-guide bar 2 by means of the supporting element 46 to which these two components 24, 46 are stiffly connected. Thanks to the translational motion imparted by the motor 10, the thread-guide bar 2 can make the "shog" movement, thus moving frontally with respect to the hook of every needle.

Simultaneously to the "shog" movement, the thread-guide bar 2 should also make the "swing" movement so as to move laterally with respect to every needle and allow a correct feeding of the thread associated to each thread-guide. The "swing" movement is generated by the oscillating movement of the support 41. Thanks to the connection of said support 41 to the second transmission element 24 and to the supporting element 46 on the first 43 and on the second engagement portion 44, said oscillating movement is stiffly transmitted from the support 41 to the thread-guide bar 2. Moreover, the second transmission element 24 and the supporting element 46 are connected to the support 41 on the two engagement portions 43, 44 by means of sleeves 45 enabling the thread-guide bar 2 to move stiffly with an oscillating movement with respect to said support 41 and, at the same time, enabling the second transmission element 24, the supporting element 46 and the bar 2 to move with the translational movement imparted by the motor 10.

The inventive idea of the present invention also includes a linear knitting machine characterized in that it comprises at least one control device 1 for thread-guide bars 2 as described above.

Advantageously, a linear knitting machine comprises a plurality of the control devices 1 as described above, since each of said devices 1 is associated to a thread-guide bar 2, conventionally being there more than one of them, generally four to ten, in each knitting machine. According to the invention, in a linear knitting machine the motors 10 of every device 1 are arranged radially so as to describe basically an arc in a plane basically parallel to the oscillation plane of the thread-guide bars 2 and allow the maximum closeness between each of the motors 10 and the corresponding bar 2, as can be inferred from FIGS. 4, 6, 9A and 9B.

Moreover, still in order to minimize the front size difference between motor 10 and thread-guide bar 2 and enable said bars 2 to work basically lined up with the corresponding motor 10, a first group of devices 1 (FIG. 9A) is associated to one of the two end portions 2*a* of the bars 2, whereas a second group of devices 1 (FIG. 9B) is associated to the opposite end portion 2*a*. Preferably, the control devices 1 are alternatively arranged on an end portion 2*a* of the bar and on the opposite one, as can be inferred from FIGS. 9A and 9B. As a result of the radial arrangement, the devices 1 on a machine can have components, such as the interface plate 30 or the first transmission element 21, differing from one another since every device 1 should have its thrust and oscillation center very close to the axis of the movable part 12 of the linear motor 10 so as to balance efforts.

The knitting machine includes at least a number of supporting elements 46 matching the number of thread-guide bars 2 and at least two supports 41 generating the oscillating motion. More to the point, each of these two supports 41 is associated to each of the second transmission elements 24 of the devices 1 and, if necessary, also to each of the supporting elements 46, whereas the other one is associated on an opposite end portion 2*a* of the thread-guide bar 2 with respect to the one to which every device 1 is associated. Similarly, every thread-guide bar 2 is associated to at least two supporting elements 46 on each of the two end portions 2*a* and also to a central supporting element 46 for an improved balancing of the knitting machine.

Preferably, the linear knitting machine according to the present invention has a so-called "portal" shape, and the motors 10 and the control devices 1 for the thread-guide bars 2 are uniformly placed inside the two shoulders of the machine.

The following description can apply for example both to warp machines of the raschel or tricot and similar types with thread-guide bars 2 having a length of about one meter and suitable for manufacturing ribbons, scarves etc., and to machines with bars 2 having a length above 3 m used for knitting clothing (stockings, pieces of cloth etc.).

The invention thus conceived can be subject to several changes and variants, all of which fall into the framework of the inventive idea.

In practice, any material or size can be choosed depending on the requirements.

Moreover, all details can be replaced by other technically equivalent elements.

The invention achieves important advantages.

Firstly, the control device for thread-guide bars of linear knitting machines according to the present invention is compact and has a significantly smaller number of components than known devices having the same function, since the motor and the thread-guide bar are connected directly by means of the first and the second transmission element and, if desired, by means of the interface plate. This gives rise to advantages as far as costs are concerned, increases the simplicity of the machine and the service life of said components and reduces the likelihood of breaks and the overall size of the machine.

Secondly, the radial arrangement of the linear motors, some of them being in contact with an end portion of the bar and the other ones in contact with the other one, and the shape as a double T of the movable part of the motor have allowed to further reduce the overall size of the knitting machine and the front size unbalance between the motor and the thread-guide bar and to enhance the balance of efforts in the machine. As a consequence, the machine can operate at high speeds and failures are less likely to occur. Moreover, the devices are structured and arranged inside the machine so that the oscillation and thrust centers for translation are basically lined up, thus enhancing the balance of efforts and, therefore, also the service life and the operation of said machine.

Figure 3A:
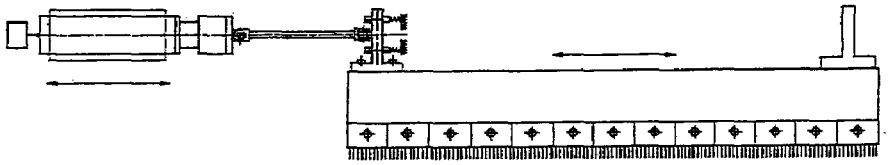
PRIOR ART FIG 3A
Figure 3B:
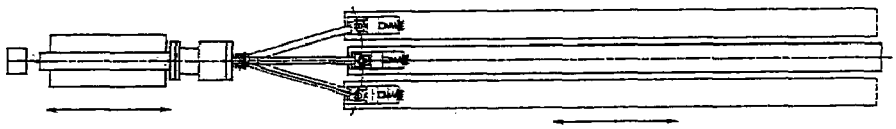
PRIOR ART FIG 3B
Figure 4:
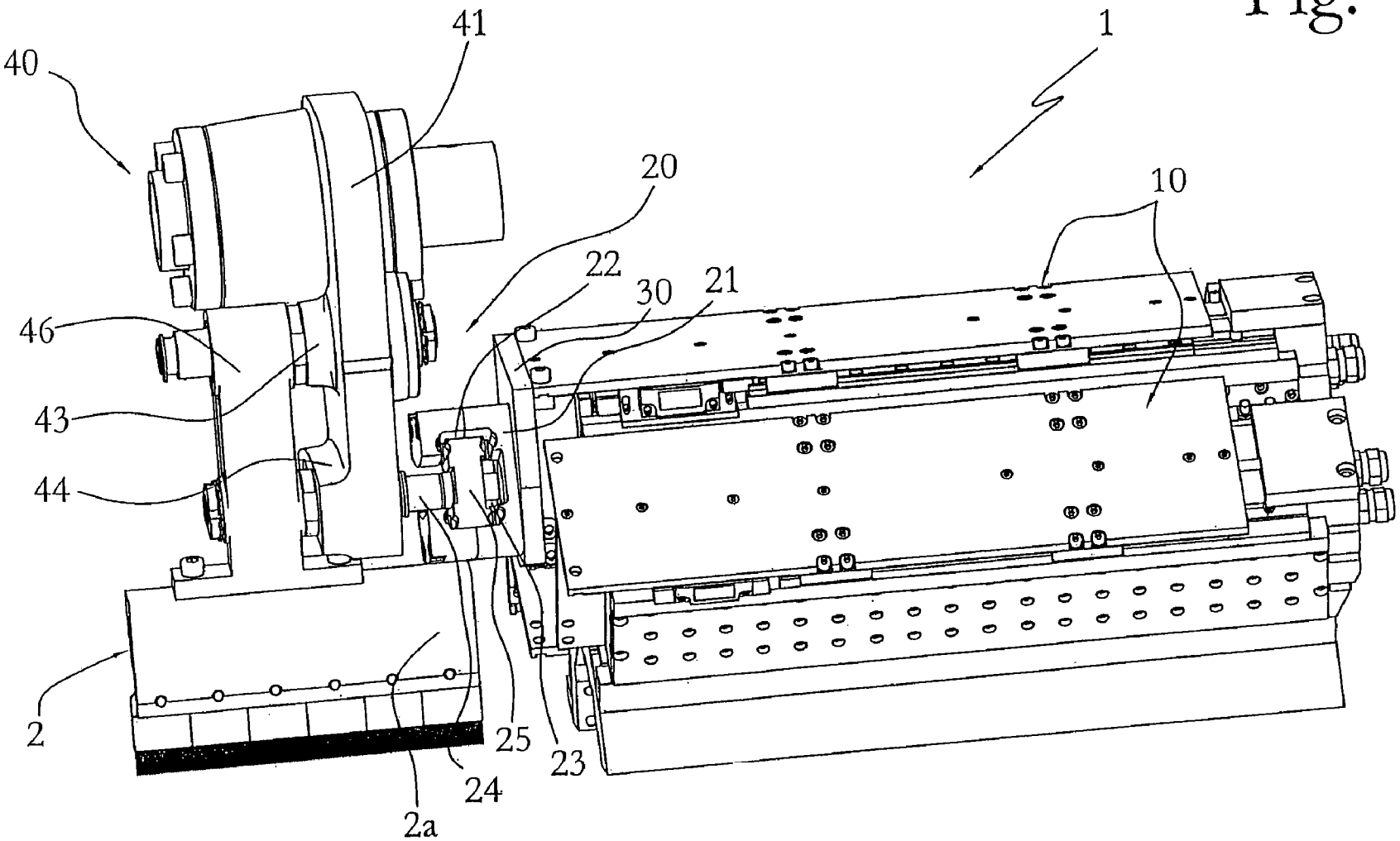
FIG. 4 shows a perspective view of a control device for thread-guide bars of linear knitting machines according to the invention, in which the device is associated to a first end portion of a thread-guide bar.

Furthermore, the devices disclosed above have a high operating accuracy and eliminate the drawback of positioning the thread out of the operating trajectory, which often occurs with known devices, thus ensuring a high-quality finished item. As a matter of fact, as was already pointed out, transmission takes place only by means of the two transmission elements operating with axes that are always parallel to the one of the motor and of the thread-guide bar, and clearances are minimized both in the motor and in the transmission means (differently from known devices, see FIG. 3B). The reduction in the number of components and their particular reciprocal shape has further made the machine less sensitive also to factors such as temperature.

A further advantage consists in that the various components are uniformly distributed inside the machine, so as to exploit every space, reduce the overall size and have a balanced and rational structure enhancing its performance and simplifying for instance maintenance or modification operations.

Eventually, the particular shape of the motor enables to minimize its front size keeping the power it generated unchanged.

What is claimed is:

1. A control device (1) for thread-guide bars (2) of warp linear knitting machines, comprising:

a linear motor (10) designed to impart a translational motion to said thread-guide bar (2), a mover (40) for moving said thread-guide bar (2) according to an oscillating motion basically perpendicular to said translational motion, and a motion transmitter (20) for transmitting to said thread-guide bar (2) said translational motion (10) of said linear motor (10), thus enabling said oscillating motion;

characterized in that said motion transmitter (20) includes a first transmission element (21) coupled to and integral with said linear motor (10), and a second transmission element (24) that is coupled integrally to said thread-guide bar (2), said first transmission element (21) having a first guide (22) in which said second transmission element (24) is movably engaged.

2. The device (1) according to claim 1, characterized in that said first guide (22) has a basically curved shape so as to enable said oscillating motion of said thread-guide bar (2).

3. The device (1) according to claim 1, characterized in that said first transmission element (21) has an inner recess (23) having at least a basically curved shape and defining said first guide (22), said second transmission element (24) having a first end portion (25) matching said recess (23) so as to oscillate inside said recess (23), in order to transmit said translational motion to said thread-guide bar (2) and to enable said oscillating motion.

4. The device (1) according to claim 3, characterized in that said recess (23) is defined by two discrete portions (21*a*) of said first transmission element (21) designed to enclose said first end portion (25) of said second transmission element (24).

5. The device (1) according to claim 1, characterized in that said second transmission element (24) has a second end portion (26), said second end portion (26) being integrally associated to said thread-guide bar (2).

6. The device (1) according to claim 3, characterized in that said transmission means (20) further include a plurality of spheres (28) located inside said recess (23) between said first (21) and said second transmission element (24), and a plurality of fastening elements (29) designed to increase pressure between said first (21) and said second transmission element (24) and said spheres (28) in said recess (23) so as to minimize clearances between said first (21) and said second transmission element (24).

7. The device (1) according to claim 1, characterized in that said transmission means (20) further include an interface plate (30) associated to said linear motor (10), said first transmission element (21) being fastened to said interface plate (30).

8. The device (1) according to claim 1, characterized in that said second transmission element (24) has a middle axis (27) that is always parallel to a direction of said translational motion.

9. The device (1) according to claim 1, characterized in that said linear motor (10) has at least one fixed part (11) and a movable part (12) designed to transmit to said thread-guide bar (2) said translational motion, said interface plate (30) or said first transmission element (21) being fastened to an end portion (12*a*) of said movable part (12).

10. The device (1) according to claim 9, characterized in that said fixed part (11) includes coils designed to generate an electromagnetic field when an electric current goes through them, and in that said movable part (12) includes magnets that are sensitive to said electromagnetic field, said movable part (12) being moved so as to generate said translational motion as a result of said electromagnetic field acting upon said magnets.

11. The device (1) according to claim 9, characterized in that said movable part (12) of said linear motor (10) is basically T-shaped so as to minimize the space occupied by said motor (10), and it is placed between at least two of said fixed parts (11).

12. The device (1) according to claim 11, characterized in that said movable part (12) of said linear motor (10) is basically shaped as a double T.

13. The device (1) according to claim 9, characterized in that said movable part (12) of said linear motor (10) is basically I-shaped so as to minimize the space occupied by said motor (10), and it is placed between at least two of said fixed parts (11).

14. The device (1) according to claim 9, characterized in that said motor (10) comprises at least one second sliding guide (13) for said movable part (12) of said motor (10).

15. The device (1) according to claim 14, characterized in that said motor (10) includes at least two of said second sliding guides (13) placed between said fixed part (11) and said movable part (12) so as to simplify the translational sliding of said movable part (12) with respect to said fixed part (11) and to minimize the distance between said movable part (12) and said fixed part (11) and the overall size of said motor (10).

16. The device according to claim 9, characterized in that it further includes detection means acting upon said motor (10) so as to drive and control the movement of said movable part (12) with respect to said fixed part (11).

17. The device according to claim 1, characterized in that, said means (40) for moving said thread-guide bar (2) according to said oscillating motion are associated to and cooperate with said transmission means (20).

18. The device (1) according to claim 17, characterized in that said means (40) for moving include a support (41) designed to move according to said oscillating motion around an axis (42) of rotation, slidingly associated to said second transmission element (24) on at least one engagement portion (43).

19. The device (1) according to claim 18, characterized in that said support (41) is further provided with a second engagement portion (44) that is slidingly associated to said second transmission element (24) for transmitting stiffly said oscillating motion and enabling said translational motion.

20. The device (1) according to claim 19, characterized in that said support (41) is engaged to said second transmission element (24) on said first (43) and said second engagement portion (44) by means of sliding sleeves (45).

21. A linear knitting machine characterized in that it comprises at least one control device (1) for thread-guide bars (2) according to claim 1.

22. The machine according to claim 21, characterized in that it comprises a plurality of said control devices (1) for thread-guide bars (2).

23. The machine according to claim 22, characterized in that said motors (10) of said plurality of devices (1) are arranged radially so as to describe basically an arc in a plane basically parallel to an oscillation plane of said thread-guide bars (2) so as to enable the maximum closeness between each of said motors (10) and the corresponding thread-guide bar (2).

24. The machine according to claim 22, characterized in that a first group of said devices (1) is associated to one of the two end portions (2*a*) of said thread-guide bars (2), whereas a second group of said devices (1) is associated to another one of said two end portions (2*a*) of said thread-guide bars (2) so as to optimize the distance between each of said motors (10) and the corresponding thread-guide bar (2).

25. The machine according to claim 22, characterized in that said means (40) for moving comprise two of said supports (41), one of said supports (41) being associated to each of said transmission elements (24) of said devices (1), and another one of said supports (41) being associated on an opposite end portion (2*a*) of said thread-guide bar (2).

* * * * *